US009080775B2

(12) United States Patent
Freeman et al.

(10) Patent No.: US 9,080,775 B2
(45) Date of Patent: Jul. 14, 2015

(54) SLIDE-IN SIMMER POTENTIOMETER FOR A HOUSEHOLD APPLIANCE

(75) Inventors: John Freeman, Knoxville, TN (US); Phil Springer, Knoxville, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 1411 days.

(21) Appl. No.: 12/778,205

(22) Filed: May 12, 2010

(65) Prior Publication Data

US 2011/0277742 A1 Nov. 17, 2011

(51) Int. Cl.

| | |
|---|---|
| ***F24C 3/00*** | (2006.01) |
| ***F24C 3/12*** | (2006.01) |
| *F23N 1/00* | (2006.01) |
| *H01C 10/32* | (2006.01) |

(52) U.S. Cl.

CPC . *F24C 3/12* (2013.01); *F23N 1/007* (2013.01); *H01C 10/32* (2013.01)

(58) Field of Classification Search

CPC ..... F23N 1/007; F23N 2035/24; H01C 10/32; Y10T 29/49348; F24C 3/12

USPC ..... 126/39 N, 39 BA; 338/162, 127; 200/14, 200/570

See application file for complete search history.

(56) References Cited

U.S. PATENT DOCUMENTS

| | | | | | |
|---|---|---|---|---|---|
| 2,396,087 | A | * | 3/1946 | Drugmand et al. | 338/253 |
| 2,841,660 | A | * | 7/1958 | Tabet | 200/14 |
| 2,971,066 | A | * | 2/1961 | Tabet | 200/11 D |
| 2,988,607 | A | * | 6/1961 | Tabet | 200/11 D |
| 3,015,000 | A | * | 12/1961 | Tabet | 200/14 |
| 3,111,640 | A | * | 11/1963 | Dial | 338/160 |
| 3,211,845 | A | * | 10/1965 | Zoltai | 200/4 |
| 3,534,184 | A | * | 10/1970 | Tabet | 200/4 |
| 3,571,534 | A | * | 3/1971 | Ashman | 200/11 D |
| 3,591,790 | A | * | 7/1971 | Couture | 708/800 |
| 3,780,238 | A | * | 12/1973 | Brant et al. | 200/11 DA |
| 3,886,514 | A | * | 5/1975 | Oka | 338/126 |
| 3,967,164 | A | | 6/1976 | Valle | |
| 4,310,824 | A | * | 1/1982 | Steigerwald | 338/174 |
| 4,363,077 | A | * | 12/1982 | Brown | 361/760 |
| 4,521,761 | A | * | 6/1985 | Welch | 338/174 |
| 4,642,602 | A | * | 2/1987 | Maisch et al. | 338/162 |
| 4,769,626 | A | * | 9/1988 | Herrera | 338/185 |
| 5,135,389 | A | * | 8/1992 | Dai et al. | 431/328 |
| 5,575,638 | A | * | 11/1996 | Witham et al. | 431/73 |
| 5,592,141 | A | * | 1/1997 | Castellano Aldave | 338/162 |
| 5,662,465 | A | | 9/1997 | Kano | |
| 5,931,150 | A | | 8/1999 | Bowen et al. | |
| 6,111,240 | A | | 8/2000 | Kishimoto et al. | |

(Continued)

*Primary Examiner* — Avinash Savani
*Assistant Examiner* — George R Blum
(74) *Attorney, Agent, or Firm* — James E. Howard; Andre Pallapies

(57) ABSTRACT

A potentiometer for a household cooking appliance including a gas valve having a valve stem. The potentiometer includes a circuit board having a contact, a wiper rotor that is rotatable with respect to the circuit board and having an opening corresponding to an axis of rotation of the wiper rotor, the opening of the wiper rotor for engaging the valve stem of the gas valve, the wiper rotor including a wiper electrically contacting the contact of the circuit board, a housing coupled to the circuit board and enclosing the wiper rotor between the housing and the circuit board, and a first interior edge and a second interior edge formed in each of the circuit board, the wiper rotor, and the housing and defining a channel extending from an outer edge of the potentiometer to the opening of the wiper rotor.

35 Claims, 11 Drawing Sheets

(56) References Cited

U.S. PATENT DOCUMENTS 7,067,745 B2 * 6/2006 Holt ..... 200/11 R
7,484,922 B2 2/2009 Harsch et al.
2003/0221498 A1 12/2003 Mere et al.
2012/0199113 A1 * 8/2012 Barrena et al. ..... 126/39 BA

* cited by examiner

SLIDE-IN SIMMER POTENTIOMETER FOR A HOUSEHOLD APPLIANCE

FIELD OF THE INVENTION

The present invention is directed to a household appliance, and more particularly, to a household cooking appliance including a slide-in simmer potentiometer.

BACKGROUND OF THE INVENTION

A household cooking appliance, such as a gas cooking range or a standalone cooktop, may include a plurality of gas burners disposed on an upper surface of the cooking appliance. A control panel may be disposed on a front surface or an upper surface of the cooking appliance and commonly includes a plurality of knobs for controlling the individual gas burners. One or more gas burners can include a simmer feature.

FIG. 9 illustrates an example of a conventional simmer assembly for a cooking appliance. The conventional simmer assembly commonly includes a control panel 6, a control knob 8, a position encoder such as a simmer potentiometer 10, a gas valve 12 having a valve stem 14, and a gas supply line 18 coupled to the gas valve 12. As illustrated in FIG. 10, the valve stem 14 may include, for example, a flat cam surface 14*a* for engaging a corresponding surface of the simmer potentiometer 10 such that the rotational movement of the valve stem 14 can rotate a part of the simmer potentiometer 10 for determining a position of the valve stem 14.

During assembly, the potentiometer 10 is first inserted onto the valve stem 14 of the gas valve 12 from the front. The valve stem 14 can engage a wiper rotor (not shown in FIG. 9) that is rotatably mounted inside a housing of the potentiometer 10. The valve stem 14 then is inserted through an opening 16 in a bracket of the control panel 6. A control knob 8 is coupled to the free end of the valve stem 14 on an opposite side (i.e., front side) of the control panel 6 from the potentiometer 10. The gas supply line 18 is coupled to the gas valve 12. A leak test commonly is performed on the simmer assembly following the assembly process.

In order to service the conventional potentiometer 10, a technician commonly has two options for removing the potentiometer 10 after it has been installed in the cooking appliance. One option is to remove the control panel 6 from the cooking appliance and then slide the potentiometer 10 off from the front of the valve stem 14 of the gas valve 12. The technician then can slide a new potentiometer onto the valve stem 14 from the front and perform the above-mentioned steps in reverse order.

Another option is to remove the control knob 8 from the valve stem 14, disconnect the gas valve 12, and then remove the valve stem 14 from the control panel 6. Once the valve stem 14 is removed from the control panel 6, the technician can slide the potentiometer 10 off of the valve stem 14 from the front. The technician then can slide a new potentiometer onto the valve stem 14 from the front and perform the above-mentioned steps in reverse order.

Each of these processes can be time consuming and may take, for example, in excess of an hour of repair time by a technician. Additionally, if the gas valve 12 is disconnected, as in the second option, then the technician also must re-test the system for leaks following the re-assembly of the system. Hence, a user commonly will need to have a technician perform these services, thereby increasing the costs and inconvenience to the consumer, as well increasing the amount of time and complexity of performing the service.

SUMMARY OF THE INVENTION

The exemplary embodiments of the present invention recognize that it is desirable to be able to quickly and efficiently remove and replace the potentiometer or position encoder of the simmer assembly without removing the control knob from the valve stem or removing the valve stem from the control panel. Moreover, the exemplary embodiments recognize that it is desirable to reduce the amount of time needed to service or replace the potentiometer, to reduce the cost of the service, and to minimize or obviate the need to re-test the system for leaks after performing the service or repair. The exemplary embodiments also recognize that it is desirable to enable a user to perform the service or repair without a technician.

These problems and others are addressed by the present invention, a first exemplary embodiment of which comprises a potentiometer for a household cooking appliance, the household cooking appliance including a gas valve having a valve stem, the potentiometer including a circuit board having a contact, a wiper rotor that is rotatable with respect to the circuit board and having an opening corresponding to an axis of rotation of the wiper rotor, the opening of the wiper rotor for engaging the valve stem of the gas valve, the wiper rotor including a wiper electrically contacting the contact of the circuit board, a housing coupled to the circuit board and enclosing the wiper rotor between the housing and the circuit board, and a first interior edge and a second interior edge formed in each of the circuit board, the wiper rotor, and the housing and defining a channel extending from an outer edge of the potentiometer to the opening of the wiper rotor.

Another exemplary embodiment of the invention comprises a potentiometer for a household cooking appliance, the household cooking appliance including a gas valve having a valve stem, the potentiometer comprising a circuit board having a contact, a wiper rotor that is rotatable with respect to the circuit board and having an opening corresponding to an axis of rotation of the wiper rotor, the opening of the wiper rotor for engaging the valve stem of the gas valve, the wiper rotor including a wiper electrically contacting the contact of the circuit board, and a housing coupled to the circuit board and enclosing the wiper rotor between the housing and the circuit board, the housing having an opening substantially corresponding to the opening of the wiper rotor, wherein the housing includes a first interior edge and a second interior edge defining a first channel extending from an outer edge of the housing to the opening of the housing.

A further exemplary embodiment of the invention comprises a household cooking appliance having a simmer control assembly, the household cooking appliance comprising a control panel, a gas valve having a body and a valve stem projecting from the body, the valve stem rotatably coupled to the body, the gas valve disposed on a first side of the control panel, the valve stem engaging an opening of the control panel such that a free end of the valve stem extends through the opening and projects from the control panel on a second side of the control panel, a control knob coupled to the free end of the valve stem on the second side of the control panel, and a potentiometer that detects a rotating position of the valve stem, the potentiometer coupled to the valve stem on the first side of the control panel. The potentiometer comprises a circuit board having a contact, a wiper rotor that is rotatable with respect to the circuit board and having an opening corresponding to an axis of rotation of the wiper rotor, the opening of the wiper rotor for engaging the valve stem of the gas valve, the wiper rotor including a wiper electrically contacting the contact of the circuit board, a housing coupled to the circuit board and enclosing the wiper rotor between the housing and the circuit board, and a first interior edge and a second interior edge formed in each of the circuit board, the wiper rotor, and the housing and defining a channel extending from an outer edge of the potentiometer to the opening of the wiper rotor.

A further exemplary embodiment of the invention comprises a household cooking appliance having a simmer control assembly, the household cooking appliance comprising a control panel, a gas valve having a body and a valve stem projecting from the body, the valve stem rotatably coupled to the body, the gas valve disposed on a first side of the control panel, the valve stem engaging an opening of the control panel such that a free end of the valve stem extends through the opening and projects from the control panel on a second side of the control panel, a control knob coupled to the free end of the valve stem on the second side of the control panel, and a potentiometer that detects a rotating position of the valve stem, the potentiometer coupled to the valve stem on the first side of the control panel. The potentiometer comprises a circuit board having a contact, a wiper rotor that is rotatable with respect to the circuit board and having an opening corresponding to an axis of rotation of the wiper rotor, the opening of the wiper rotor for engaging the valve stem of the gas valve, the wiper rotor including a wiper electrically contacting the contact of the circuit board, and a housing coupled to the circuit board and enclosing the wiper rotor between the housing and the circuit board, the housing having an opening substantially corresponding to the opening of the wiper rotor, wherein the housing includes a first interior edge and a second interior edge defining a first channel extending from an outer edge of the housing to the opening of the housing.

In this manner, the exemplary embodiments of the present invention provide a potentiometer for a simmer assembly that can be quickly and efficiently removed and replaced, for example, without removing the control knob from the valve stem or removing the valve stem from the control panel, thereby reducing an amount of time needed to perform service, reducing the cost of servicing the simmer assembly, and/or eliminating the performance of an additional leak test after replacing the potentiometer.

The exemplary embodiments of a potentiometer can include a channel formed therein that extends at least from an outside edge of the potentiometer to an opening surrounding the axis of rotation of the wiper rotor. In this manner, the exemplary channel can provide an unobstructed access path for the potentiometer to slide onto the valve stem of the gas valve from above, below, or from the side of the valve stem, as opposed to sliding on from the front, thereby eliminating the need to remove the control panel or the gas valve to remove or install the potentiometer.

The exemplary embodiments provide important advantages in that the potentiometer can be quickly and efficiently removed and replaced, for example in only a few minutes, and without disturbing the remaining parts of the simmer assembly. Moreover, the present invention reduces the complexity and simplifies the repair/replacement process. In many cases, the potentiometer can be serviced by a user without a technician and/or without re-testing the system for leaks, thereby saving the user time, minimizing the inconvenience to the user, and reducing costs to the user.

Furthermore, the exemplary embodiments can provide a potentiometer that can be easily and efficiently removed and replaced at the manufacturing facility, thereby reducing costs to the manufacturer. For example, in an event that a quality control inspection reveals that a potentiometer (or a batch of potentiometers) fails to meet predetermined quality standards, is deemed to be faulty, etc., the potentiometer according to the exemplary embodiments can be quickly and efficiently removed and replaced from each of the cooking appliances prior to shipment from the manufacturing facility without disturbing the remaining parts of the simmer assembly or requiring additional lead testing, etc.

Moreover, the manufacturer can quickly and efficiently replace previous versions of potentiometers that have already been installed in existing inventory with upgraded or revised versions of the potentiometer, thereby providing greater flexibility, for example, in implementing new backwards compatible designs into existing inventory while minimizing additional costs and time.

For purposes of the invention, the channel of the potentiometer can be an opening, a gap, a notch, a slot, a keyway, or the like that can provide an unobstructed path along which the valve stem can move (e.g., slide) with respect to the potentiometer such that the potentiometer can be inserted onto the valve stem from above, below, or from the side (e.g., from one or more directions that are perpendicular to the longitudinal length of the valve stem) and such that the wiper rotor can engage the valve stem.

The channel can extend through a thickness of the assembly of the circuit board, the wiper rotor, and the housing. The channel can include a depth equal to the overall thickness of the assembly, including the circuit board, the wiper rotor, and the housing, and can have a width equal to or greater than a width of the valve stem in a direction perpendicular to the longitudinal length of the valve stem.

The channel can be defined, for example, by at least two interior edges or sidewalls of the potentiometer. More particularly, the channel can be defined by interior edges of the circuit board, the wiper rotor, and the housing. For example, in an exemplary embodiment of the potentiometer, each of the circuit board, the wiper rotor, and the housing can include an opening or channel that extends at least from an outside edge of each element to an opening surrounding the axis of rotation of the wiper rotor.

In an exemplary embodiment, the opening of the wiper rotor can include a flat cam surface that engages a flat cam surface of the valve stem. One of ordinary skill in the art will recognize that the valve stem can include other shapes and is not limited to a D-shaped cross-section having a flat cam surface. Similarly, the opening of the wiper rotor can include other shapes that correspond to the cross-section of the valve stem such that the movement of the valve stem (e.g., rotation) can be transmitted to the wiper rotor. For example, the opening of the wiper rotor can include a notch or protrusion for engaging a corresponding protrusion or notch formed in the valve stem. In other exemplary embodiments, the opening of the wiper rotor can include a star shape, square shape, rectangular shape, hexagonal shape, etc., for engaging a valve stem having a corresponding cross-section of a star shape, square shape, rectangular shape, hexagonal shape, etc.

In an exemplary embodiment, the circuit board is fixedly secured to the housing when the potentiometer is assembled. In this manner, the location of the channel of the housing substantially can correspond to, and be fixed with respect to, the channel of the circuit board. Preferably, the size and shape of the channel of the housing substantially can correspond to a size and shape of the channel of the circuit board. The wiper rotor can be rotatably coupled to the circuit board and disposed between the circuit board and the housing. In this manner, the wiper rotor can be movable (e.g., rotatable about the axis) between a first position in which the channel of the wiper rotor substantially is aligned with the channel of the housing and the channel of the circuit board, and a second position in which the channel of the wiper rotor substantially is not aligned with the channel of the housing and the channel of the circuit board.

In an exemplary embodiment, the channels of each component can have substantially similar shapes and sizes such that the channel of the potentiometer substantially is uniform throughout a depth of the channel in a direction of the axis of the wiper rotor when the channel of the wiper rotor is aligned with the channels of the circuit board and the housing, respectively. In a preferred embodiment, the size, shape, and arrangement of the channels of the circuit board, the wiper rotor, and the housing can be substantially the same.

In other exemplary embodiments, one or more of the channels of each component can have a different shape and/or size from one or more of the other channels. For example, the channels of the circuit board and housing, respectively, can have a substantially similar shape and/or size, while the size and/or shape of the channel of the wiper rotor can be different from that of the channels of the circuit board and the wiper rotor. For example, the wiper rotor can include interior edges that define a channel having a pie-shaped channel section that provides an unobstructed access path from the outer edge of the potentiometer to the axis of rotation A of the wiper rotor when the pie-shaped channel section of the wiper rotor is aligned with the channels of the circuit board and the housing, respectively.

The channels of the individual components can have a variety of sizes, shapes, and arrangements within the spirit and scope of the invention. For example, in an exemplary embodiment, the channel can be a straight or linear channel extending, for example, in a direction along a radius of the wiper rotor from the edge of the potentiometer toward the axis of rotation of the wiper rotor. In another exemplary embodiment, the channel can be a curved channel extending from the edge of the potentiometer toward the axis of rotation of the wiper rotor. In other exemplary embodiments, the channel can include a combination of straight channels, angled channels, curved channels, or other shaped channels extending from the edge of the potentiometer toward the axis of rotation of the wiper rotor.

The size, shape, and/or arrangement of the channels preferably can be selected, for example, based on the position of the electrical components on the circuit board. In this manner, the potentiometer can be configured, for example, to be backwards compatible with existing designs for circuit boards and/or gas valves, thereby minimizing or reducing costs associated with the potentiometer.

In other exemplary embodiments, the electrical components (e.g., contacts, circuits, etc.) of the circuit board and/or the design of the gas valve can be arranged or selected to accommodate a channel having a predetermined size, shape, and/or arrangement, such as a curved channel, a linear or straight channel, an angled channel, or combinations thereof In an exemplary embodiment, each of the channels can include one or more channel portions or parts. Each of the channel portions can be defined by a first sidewall (i.e., a first interior edge) that is opposed to a second sidewall (i.e., a second interior edge). The first sidewall and the second sidewall can define a space or channel there between. The first sidewalls of the first channel portion, the second channel portion, and the third channel portion can be adjoined to each other in series. Similarly, the second sidewalls of the first channel portion, the second channel portion, and the third channel portion can be adjoined to each other in series.

In an exemplary embodiment, the first and second sidewalls of the first, second, and third channel portions can be parallel to each other, respectively, at each portion. In other exemplary embodiments, a distance can vary between the first and second sidewalls, respectively, of the first, second, and third channel portions.

In an exemplary embodiment, the second channel portion can be arranged at an angle with respect to the first channel portion. For example, the first portion can be adjoined at a first angle with the second portion of each of the interior edges. Similarly, the first portion of each of the interior edges can be adjoined at a second angle with the second portion of each of the interior edges. In an exemplary embodiment, the first angle can be substantially equal to the second angle. In another exemplary embodiment, the first angle can be different than the second angle. In yet another exemplary embodiment, the first angle can be less than or greater than the second angle. In this manner, the exemplary embodiment can provide sufficient clearance for movement of the valve stem along the channel and around the corners connecting the first and second channel portions.

Additionally or alternatively, a length of a portion of the first sidewall can be different than a length of a corresponding opposed portion of the second sidewall. In this manner, the exemplary embodiment can provide sufficient clearance for movement of the valve stem along the channel and around the corners connecting the first and second channel portions, or the second and third portions, etc.

Another exemplary embodiment of a potentiometer can include a wiper rotor having an insulating film corresponding to an opening in the wiper rotor for receiving and securing the wipers to the wiper rotor. The insulating film can be disposed on a rear side of the wiper rotor (i.e., an opposite side of the wiper rotor from the wiper). The insulating film can cover only a portion of the wiper rotor corresponding to an attachment point of the wipers to the wiper rotor, or substantially the entire planar surface of the wiper rotor. In the latter embodiment, the insulating film can include a channel that corresponds substantially to the channel of the potentiometer, or more particularly the channel of the wiper rotor, so as not to interfere with the sliding of the potentiometer onto the valve stem, for example, from the top, side, or bottom. The insulating film can include, for example, an insulating material having an adhesive backing In a preferred embodiment, the insulating film can include a polyester strip, such as a 0.010" polyester strip, or other insulating material, having a self-sticking adhesive backing In other embodiments, the insulating material can be adhered to the surface of the wiper rotor using an adhesive, tape, or the like.

In this manner, the exemplary embodiments can provide a potentiometer that can comply, for example, with standards and regulations from regulatory organizations such as Underwriters Laboratories, Inc. (UL), by providing an insulating material (e.g., insulating film) between the portion of the wipers (which are disposed in the openings formed in the wiper rotor to secure the wipers to the wiper rotor) and the gas valve.

An exemplary embodiment of a potentiometer can include a connector that is positioned on the circuit board such that the connectors extend away from the circuit board in a direction substantially parallel to the axis of rotation of the wiper rotor when the potentiometer is in an assembled state. In this manner, the connectors can be accessed more easily from the rear of the potentiometer when the potentiometer is installed on the valve stem of the gas valve of the cooking appliance. Alternatively, the connector can be positioned on the circuit board such that the connectors extend away from the circuit board in a direction substantially perpendicular to the axis of rotation of the wiper rotor when the potentiometer is in an assembled state.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
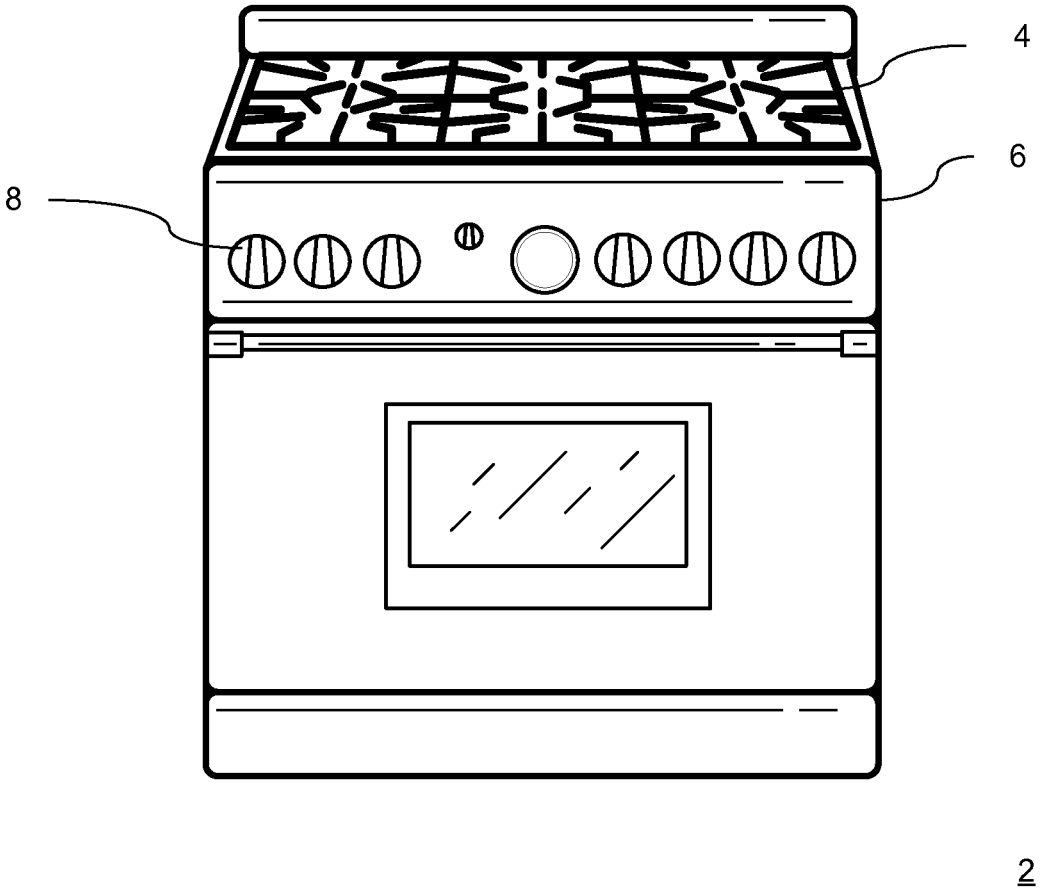
FIG. 1 is a front elevation view of a household cooking appliance.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-8D illustrate exemplary embodiments of a household cooking appliance, and more particularly, a simmer potentiometer for a household cooking appliance.

With reference to the exemplary embodiment of FIG. 1, a household cooking appliance can include, for example, a gas cooking range 2. In other embodiments, the household appliance can include a standalone cooktop or the like. A plurality of gas burners can be disposed on an upper surface 4 of the cooking appliance. A control panel 6 can be disposed, for example, on a front surface or an upper surface of the cooking appliance. The control panel 6 can include a plurality of control knobs 8 for controlling the individual gas burners. One or more of the gas burners can include a simmer feature.

Figure 9:
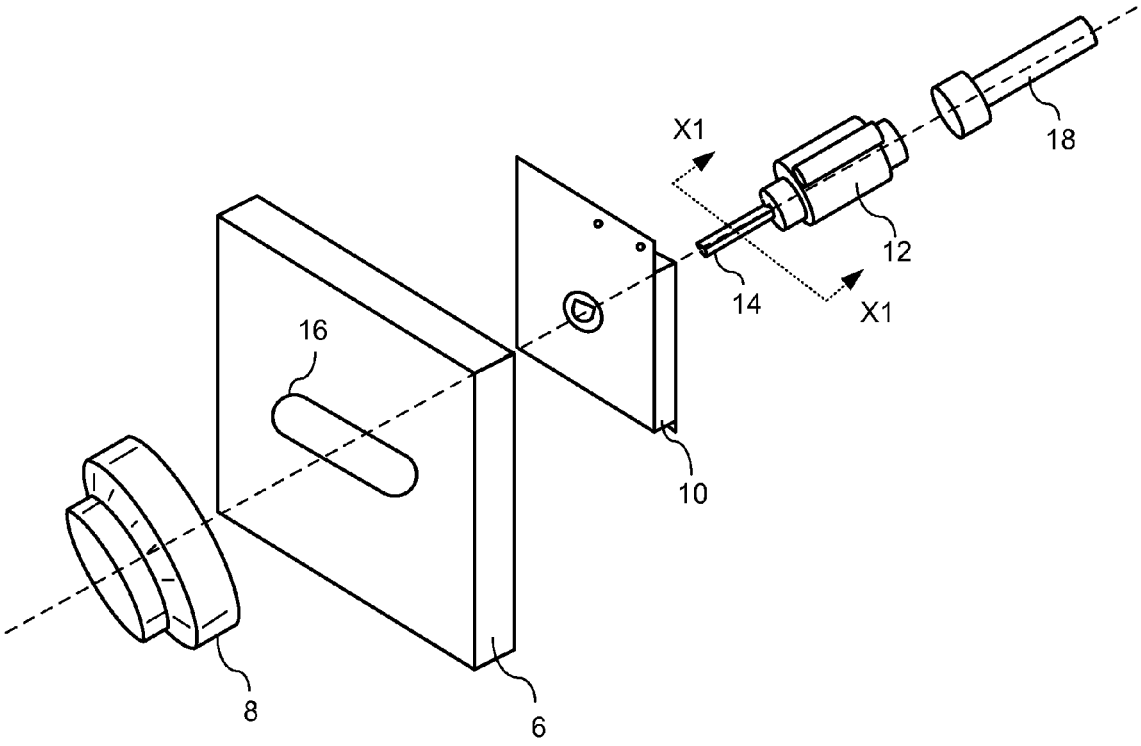
FIG. 9 CONVENTIONAL ART
FIG. 9 is an exploded, front perspective view of a conventional simmer controller assembly.

The exemplary embodiments provide a novel simmer potentiometer that can be substituted for a conventional potentiometer (e.g., 10 in FIG. 9) in a conventional simmer assembly for a cooking appliance, which includes, for example, a control panel 6, a control knob 8, a gas valve 12 having a valve stem 14, and a gas supply line 18. One of ordinary skill in the art will recognize that other simmer assembly arrangements are possible and the exemplary embodiments are not limited to the illustrated arrangements.

With reference to FIGS. 2-6B, a slide-in simmer potentiometer 20 according to an exemplary embodiment will now be described.

Figure 2:
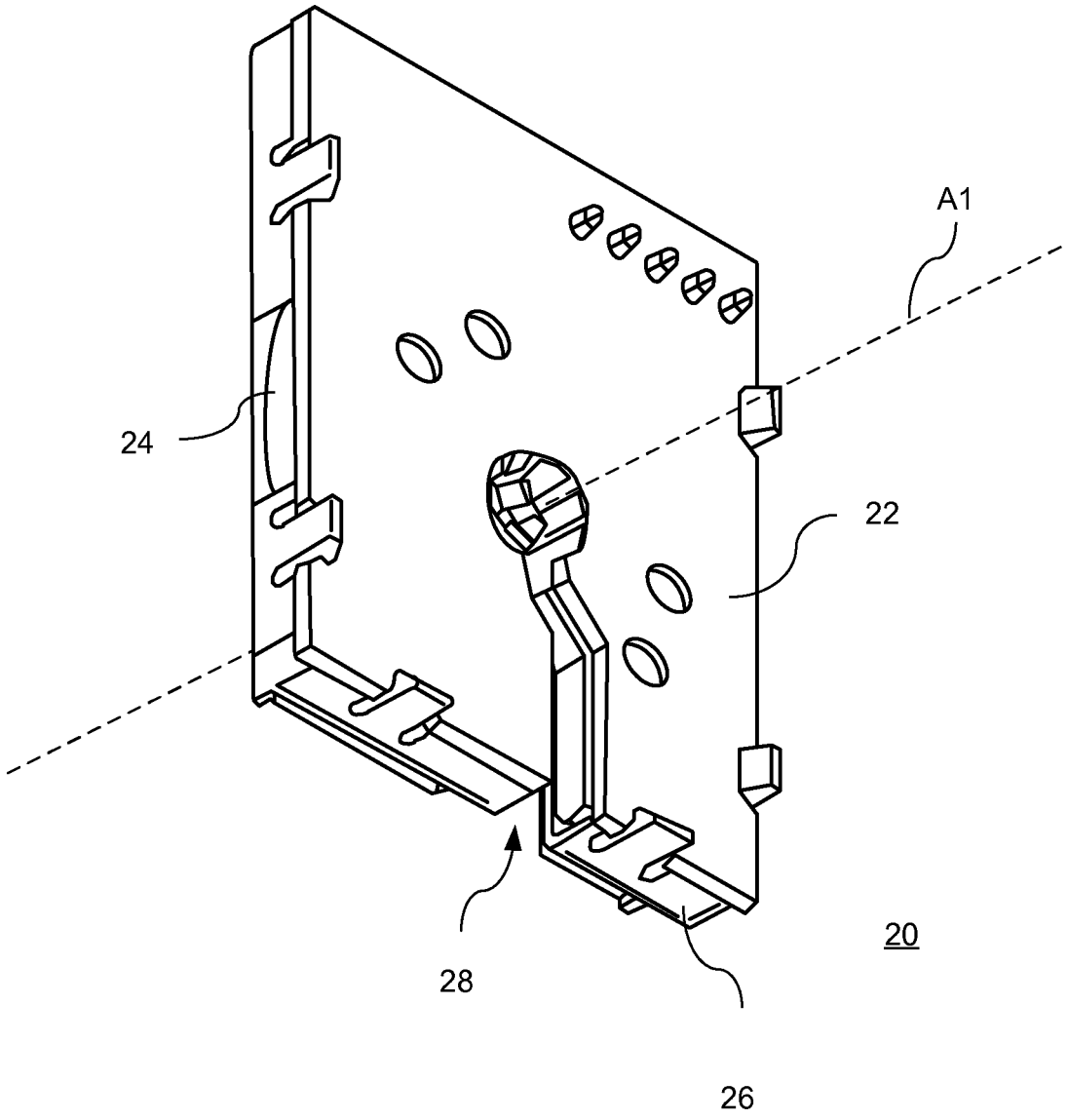
FIG. 2 is a front, perspective view of a potentiometer assembly according to an exemplary embodiment of the invention.
Figure 3A:
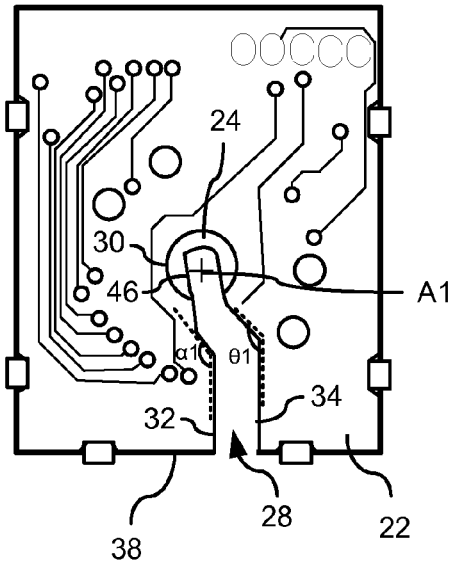
FIGS. 3A and 3B are front views of a potentiometer assembly according to an exemplary embodiment of the invention.
Figure 3B:
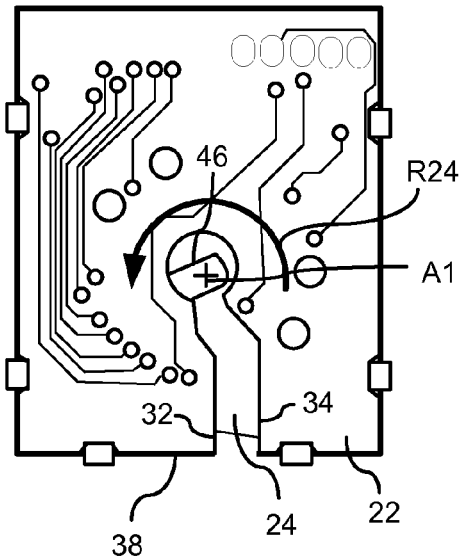
Figure 3C:
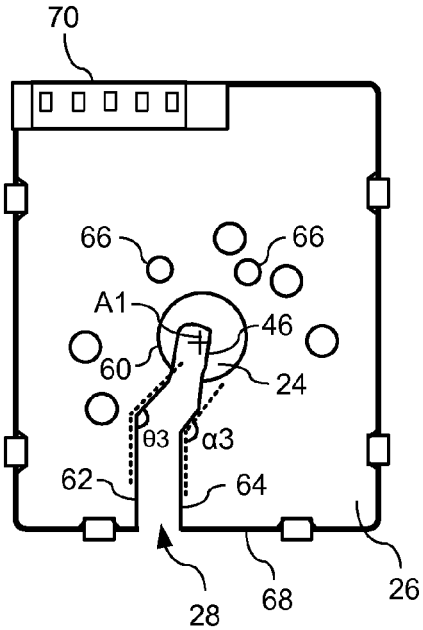
FIGS. 3C and 3D are rear views of a potentiometer assembly according to an exemplary embodiment of the invention.
Figure 3D:
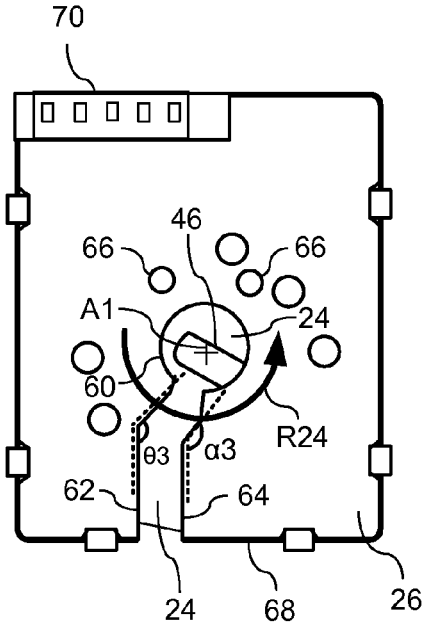

As illustrated in FIGS. 2-3D, an exemplary slide-in simmer potentiometer 20 can include, among other features, a circuit board 22, a wiper rotor 24, and a housing 26. The individual features of the exemplary circuit board 22, wiper rotor 24, and housing 26 will be described in greater detail with reference to FIGS. 4A-6B.

With reference again to FIGS. 2-3D, the wiper rotor 24 can be rotatably coupled to the circuit board 22 and disposed between the circuit board 22 and the housing 26. The wiper rotor 24 can be rotatable about an axis of rotation A1. The potentiometer 20 can include a channel 28 formed therein that extends at least from an outside edge of the potentiometer 22 to an opening surrounding the axis of rotation A1 of the wiper rotor 24. The channel 28 can extend through a thickness of the assembly of the circuit board 22, the wiper rotor 24, and the housing 26. The channel 28 can include a depth equal to the thickness of the assembly of the circuit board 22, the wiper rotor 24, and the housing 26, and can have a width equal to or greater than a width of the valve stem 14 in a direction perpendicular to the longitudinal length of the valve stem 14. In this manner, the exemplary channel 28 can provide an unobstructed access path for the potentiometer 20 to slide onto the valve stem 14 of the gas valve 12 from above, below, or from the side of the valve stem 14, as opposed to sliding on from the front, thereby eliminating the need to remove the control panel 6 or the gas valve 12 to remove or install the potentiometer 20.

The channel 28 of the potentiometer can be an opening, a gap, a notch, a slot, a keyway, or the like that can provide an unobstructed path along which the valve stem 14 can move (e.g., slide) with respect to the potentiometer 20 such that the potentiometer 20 can be inserted onto the valve stem 14 from above, below, or from the side (e.g., from one or more directions that are perpendicular to the longitudinal length of the valve stem 14) and such that the wiper rotor 24 can engage the valve stem 14.

The channel 28 can be formed by one or more features of the circuit board 22, the wiper rotor 24, and the housing 26. For example, in an exemplary embodiment of the potentiometer 20, each of the circuit board 22, the wiper rotor 24, and the housing 26 can include an opening or channel 28*a*, 28*b*, and 28*c*, respectively, that extends at least from an outside edge of each element to an opening surrounding the axis of rotation A1 of the wiper rotor 24.

With reference to FIGS. 4A-6B, exemplary embodiments of a circuit board 22, a wiper rotor 24, and a housing 26 will now be described.

Figure 4A:
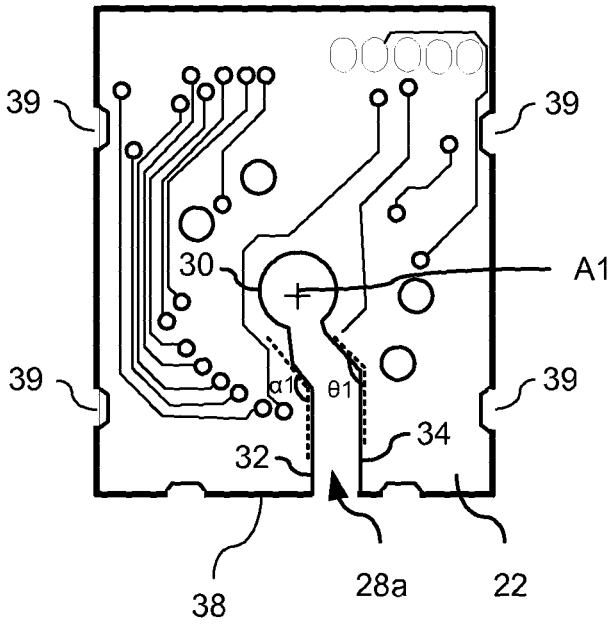
FIG. 4A is a front view of a circuit board of a potentiometer assembly according to an exemplary embodiment of the invention.
Figure 4B:
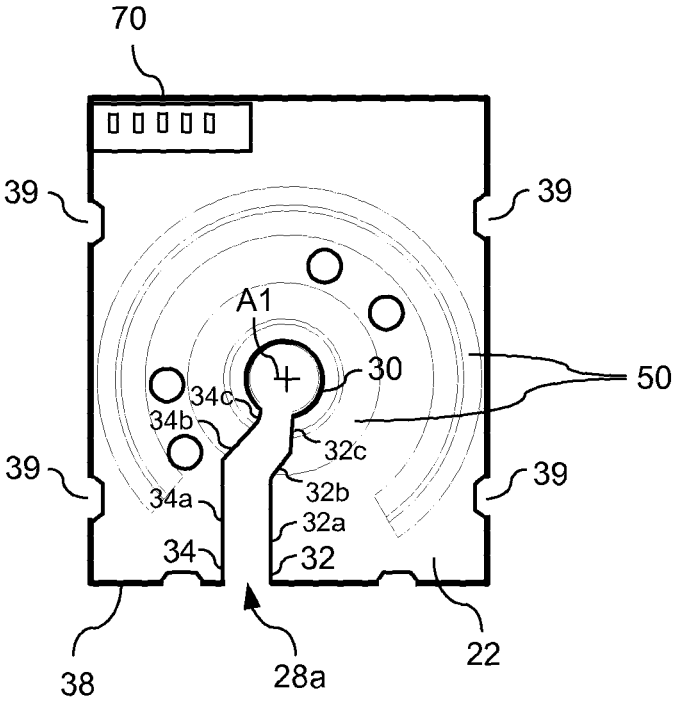
FIG. 4B is a rear view of a circuit board of a potentiometer assembly according to an exemplary embodiment of the invention.

As shown in FIGS. 4A and 4B, an exemplary embodiment of the circuit board 22 can include an opening 30 corresponding to the axis of rotation A1 of the wiper rotor 24 when the potentiometer 20 is assembled. The circuit board 22 can include a first interior edge or sidewall 32 and a second interior edge or sidewall 34 that define a channel 28*a* extending from an outer edge 38 of the circuit board 22 to the opening 30 of the circuit board 22. In the illustrated exemplary embodiment, the circuit board 22 has a square shape. One of ordinary skill in the art will recognize that the circuit board 22 is not limited to a square or rectangular shape. In other embodiments, the circuit board 22 can have other shapes, such as a circular shape, etc. The circuit board 22 can include a plurality of notches 39 for engaging locking tabs (not shown in FIGS. 4A and 4B) of the housing 26. The locking tabs will be described with reference to FIGS. 6A and 6B. The circuit board 22 can include one or more contacts, such as arch-shaped contacts 50 electrically contacting the wipers 55 (shown in FIGS. 5A and 5B) of the wiper rotor 24 in an assembled state. The circuit board 22 can include an electrical connector 70. Exemplary embodiments of the electrical connector 70 will be described in more detail below.

Figure 5A:
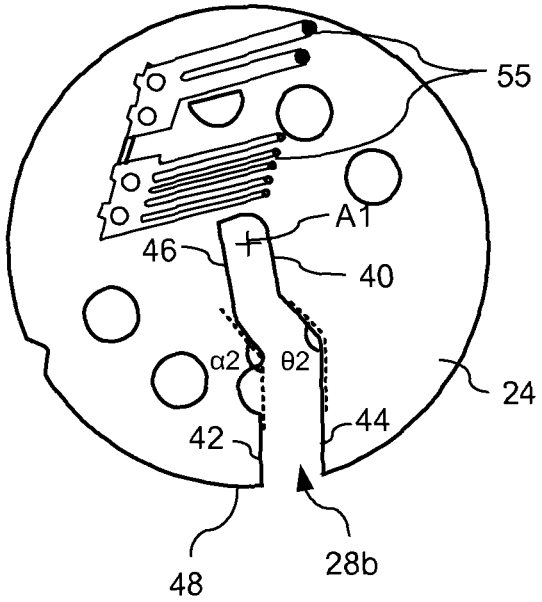
FIG. 5A is a front view of a wiper rotor of a potentiometer assembly according to an exemplary embodiment of the invention.
Figure 5B:
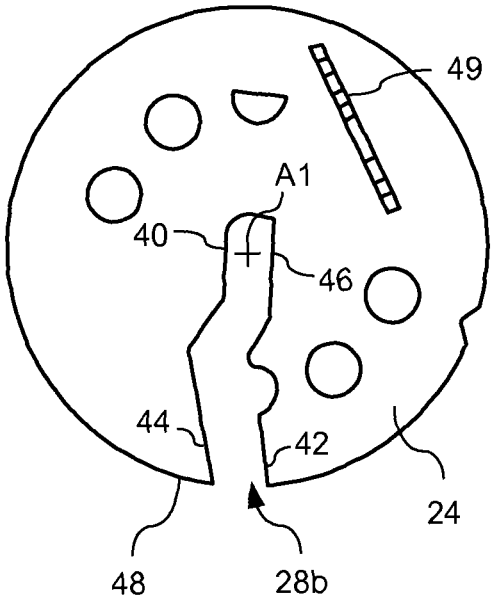
FIG. 5B is a rear view of a wiper rotor of a potentiometer assembly according to an exemplary embodiment of the invention.

As shown in FIGS. 5A and 5B, an exemplary embodiment of the wiper rotor 24 can include an opening 40 corresponding to the axis of rotation A1. The wiper rotor 24 can include a first interior edge or sidewall 42 and a second interior edge or sidewall 44 that define a channel 28*b* extending from an outer edge 48 of the wiper rotor 24 to the opening 40 of the wiper rotor 24. In the illustrated exemplary embodiment, the wiper rotor 24 has a circular shape. One of ordinary skill in the art will recognize that the wiper rotor 24 is not limited to a circular shape. In other embodiments, the wiper rotor 24 can have other shapes, such as a semi-circular shape, oval shape, square shape, rectangular shape, linear shape, etc.

The wiper rotor 24 can include one or more wipers 55 electrically contacting the contacts 50 of the circuit board 22. The wiper rotor 24 can be rotatably coupled to the circuit board 22 such that the wipers 55 can move along the contacts 50 of the circuit board 22 as the wiper rotor 24 rotates with respect to the circuit board 22. The wiper rotor 24 can include one or more openings 49 formed therein for receiving a portion of the wipers 55 and securing the wipers 55 to the wiper rotor 24.

Figure 10:
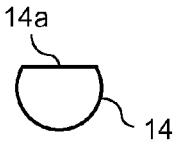
FIG. 10 CONVENTIONAL ART
FIG. 10 is a cross-sectional view of the conventional valve stem of FIG. 9 taken along section X1-X1.

The opening 40 of the wiper rotor 24 can engage the valve stem 14 of the gas valve 12. In an exemplary embodiment, the opening 40 can include a flat cam surface 46 that engages the flat cam surface 14*a* of the valve stem 14. One of ordinary skill in the art will recognize that the valve stem 14 can include other shapes and is not limited to a D-shaped cross-section having a flat cam surface 14*a*, as illustrated for example in FIG. 10. Similarly, the opening 40 of the wiper rotor 22 can include other shapes that corresponds to the cross-section of the valve stem 14 such that the movement of the valve stem 14 (e.g., rotation) can be transmitted to the wiper rotor 22. For example, the opening 40 of the wiper rotor 22 can include a notch or protrusion for engaging a corresponding protrusion or notch formed in the valve stem 14. In other exemplary embodiments, the opening 40 of the wiper rotor can include a star shape, square shape, rectangular shape, hexagonal shape, etc., for engaging a valve stem 14 having a corresponding cross-section of a star shape, square shape, rectangular shape, hexagonal shape, etc.

Figure 6A:
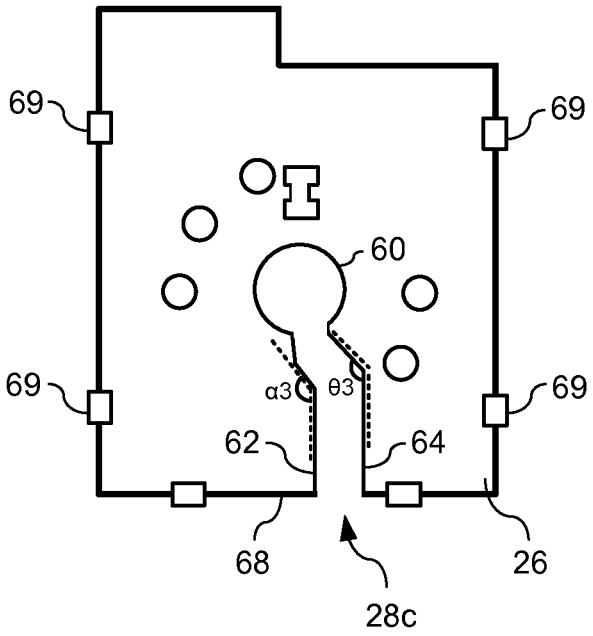
FIG. 6A is a front view of a housing of a potentiometer assembly according to an exemplary embodiment of the invention.
Figure 6B:
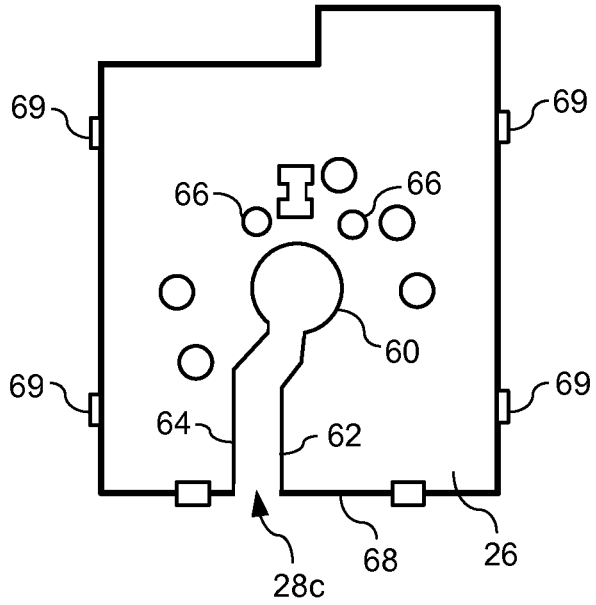
FIG. 6B is a rear view of a housing of a potentiometer assembly according to an exemplary embodiment of the invention.

As shown in FIGS. 6A and 6B, an exemplary embodiment of the housing 26 can include an opening 60 corresponding to the axis of rotation A1 of the wiper rotor 24. The housing 26 can include a first interior edge or sidewall 62 and a second interior edge or sidewall 64 that define a channel 28*c* extending from an outer edge 68 of the housing 26 to the opening 60 of the housing 26. In the illustrated exemplary embodiment, the housing 26 has a square or rectangular shape. One of ordinary skill in the art will recognize that the housing 26 is not limited to a square or rectangular shape. In other exemplary embodiments, the housing 26 can have other shapes, such as a circular shape, etc. The housing 26 can include one or more locking tabs 66 for engaging a body of the gas valve 12 and fixing the position of the housing 26 with respect to the gas valve 12 when the potentiometer 20 is installed in the cooking appliance. The housing 26 can include a plurality of locking tabs 69 that engage the notches 39 of the circuit board 22 to secure the housing 26 to the circuit board 22.

With reference to FIGS. 4A-6B, the openings 30, 40, and 60 of the circuit board 22, the wiper rotor 24, and the housing 26, respectively, can be concentric circles, or portions of circles, having substantially equal diameters. In other embodiments, one or more of the openings 30, 40, and 60 can have a different diameter than another of the openings. One of ordinary skill in the art will recognize that the openings are not limited to the shapes in the illustrated embodiments, and can include any suitable shape that permits the valve stem 14 to engage the wiper rotor 24 and rotate freely along with the wiper rotor 24 without obstruction from the circuit board 22 or the housing 26.

With reference again to the exemplary embodiment of FIGS. 2-3D, additional exemplary features of an assembled potentiometer 20 including a circuit board 22, wiper rotor 24, and housing 26 will now be described.

As shown in FIGS. 2-3D, the tabs 69 of the housing can engage the notches 39 of the circuit board 22 and fixedly secure the housing 26 to the circuit board 22 when the potentiometer 20 is assembled. In this manner, the location of the channel 28*c* of the housing 26 substantially can correspond to, and be fixed with respect to, the channel 28*a* of the circuit board 22. Preferably, the size and shape of the channel 28*c* of the housing 26 substantially can correspond to a size and shape of the channel 28*a* of the circuit board 22.

The wiper rotor 24 can be rotatably coupled to the circuit board 22 and disposed between the circuit board 22 and the housing 26. In this manner, the wiper rotor 24 can be movable (e.g., rotatable about the axis A1) between a first position in which the channel 28*b* of the wiper rotor 24 substantially is aligned with the channel 28*c* of the housing 26 and the channel 28*a* of the circuit board 22, as shown in FIGS. 3A and 3C, and a second position in which the channel 28*b* of the wiper rotor 24 substantially is not aligned with the channel 28*c* of the housing 26 and the channel 28*a* of the circuit board 22, as shown in FIGS. 3B and 3D.

In the exemplary embodiments illustrated in FIGS. 2-6B, the channels 28*a*, 28*b*, and 28*c* can have substantially similar shapes and sizes such that the channel 28 substantially is uniform throughout a depth of the channel 28 in a direction of the axis A1 when the channel 28*b* of the wiper rotor 24 is aligned with the channels 28*a* and 28*c* of the circuit board 22 and the housing 26, respectively. In a preferred embodiment, the size, shape, and arrangement of the channels 28*a*, 28*b*, and 28*c* of the circuit board 22, the wiper rotor 24, and the housing 26 can be substantially the same such that $\alpha 1=\alpha 2=\alpha 3$ and $\theta 1=\theta 2=\theta 3$.

In other exemplary embodiments, one or more of the channels 28*a*, 28*b*, and 28*c* can have a different shape and/or size from one or more of the other channels. For example, the channels 28*a* and 28*c* of the circuit board and housing, respectively, can have a substantially similar shape and/or size, while the size and/or shape of the channel 28*b* of the wiper rotor can be different from that of the channels 28*a* and 28*c*. For example, the wiper rotor 24 can include interior edges that define a channel 28*b* having a pie-shaped channel section that provides an unobstructed access path from the outer edge of the potentiometer 20 to the axis of rotation A1 of the wiper rotor 24 when the pie-shaped channel section 28*b* of the wiper rotor 24 is aligned with the channels 28*a* and 28*c* of the circuit board 22 and the housing 26, respectively.

The channel 28 (e.g., channels 28*a*, 28*b*, and 28*c*) can have a variety of sizes, shapes, and arrangements within the spirit and scope of the invention. For example, in an exemplary embodiment, the channel 28 can be a straight or linear channel extending, for example, in a direction along a radius of the wiper rotor 24 from the edge of the potentiometer 20 toward the axis of rotation of the wiper rotor 24. In another exemplary embodiment, as shown for example in FIG. 3E, the channel 28 can be a curved channel extending from the edge of the potentiometer 20 toward the axis of rotation Al of the wiper rotor 24. In other exemplary embodiments, as shown for example in FIG. 3F, the channel 28 can include a combination of straight channels, angled channels, curved channels, or other shaped channels extending from the edge of the potentiometer 20 toward the axis of rotation Al of the wiper rotor 24.

The size, shape, and/or arrangement of the channel 28 preferably can be selected, for example, based on the position of the electrical components on the circuit board 22. In this manner, the potentiometer 20 can be configured, for example, to be backwards compatible with existing designs for circuit boards and/or gas valves, thereby minimizing or reducing costs associated with the potentiometer 20.

Figure 3E:
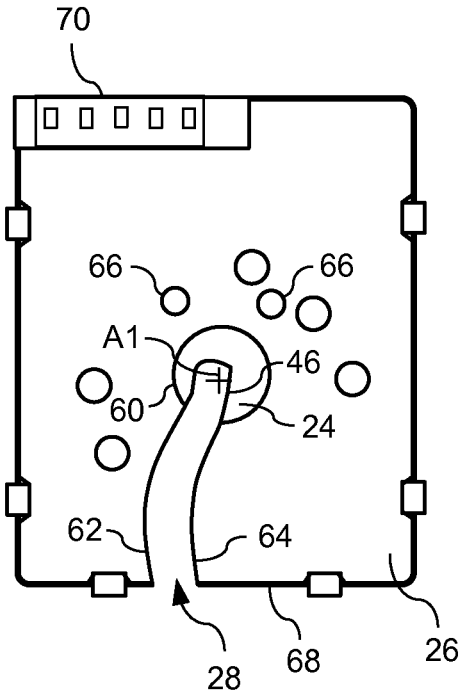
FIGS. 3E and 3F are front views of potentiometer assemblies according to other exemplary embodiments of the invention.
Figure 3F:
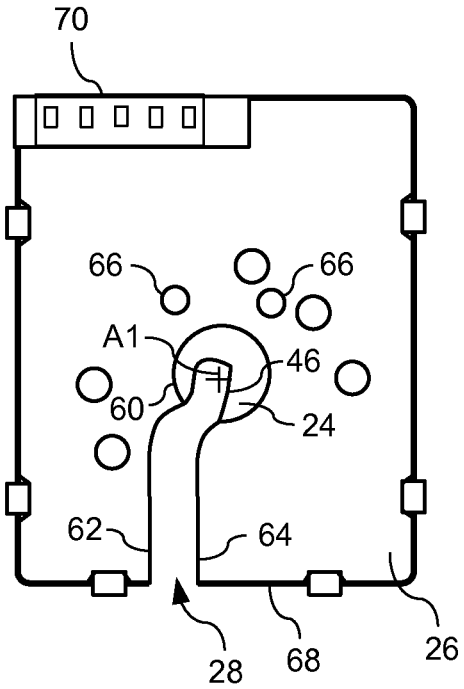

In other exemplary embodiments, the electrical components (e.g., contacts 50, circuits, etc.) of the circuit board 22 and/or the design of the gas valve 12 can be arranged or selected to accommodate a channel 28 having a predetermined size, shape, and/or arrangement, such as a curved channel as shown for example in FIG. 3E, a linear or straight channel, an angled channel, or combinations thereof as shown for example in FIG. 3F.

In an exemplary embodiment, each of the channels 28*a*, 28*b*, and 28*c* can include one or more channel portions or parts. The channel portions are described with reference to FIG. 4B. However, each of the circuit board 22, wiper rotor 24, and housing 26 similarly can include one or more channels portions. As illustrated in FIG. 4B, the channel 28*a* of the circuit board 22 can include a first channel portion 32*a*, 34*a*, a second channel portion 32*b*, 34*b*, and a third channel portion 32*c*, 34*c* arranged in series. Each of the channel portions can be defined by a first sidewall 32*a*, 32*b*, 32*c* (i.e., a first interior edge) that is opposed to a second sidewall 34*a*, 34*b*, 34*c* (i.e., a second interior edge). The first sidewall and the second sidewall define a space or channel there between. The first sidewalls of the first channel portion, the second channel portion, and the third channel portion can be adjoined to each other in series. Similarly, the second sidewalls of the first channel portion, the second channel portion, and the third channel portion can be adjoined to each other in series.

In an exemplary embodiment, the first and second sidewalls of the first, second, and third channel portions can be parallel to each other, respectively, at each portion. In other exemplary embodiments, a distance can vary between the first and second sidewalls, respectively, of the first, second, and third channel portions.

With reference to the exemplary embodiments of FIGS. 4A, 5A, and 6A, the second channel portion can be arranged at an angle with respect to the first channel portion. For example, the first portion of each of the interior edges 32, 42, and 62, respectively, can be adjoined at a first angle ($\alpha 1$, $\alpha 2$, $\alpha 3$, respectively) with the second portion of each of the interior edges 32, 42, and 62. Similarly, the first portion of each of the interior edges 34, 44, and 64, respectively, can be adjoined at a second angle ($\theta 1$, $\theta 2$, $\theta 3$, respectively), with the second portion of each of the interior edges 34, 44, and 64.

In an exemplary embodiment, the first angle (e.g., $\alpha 1$, $\alpha 2$, $\alpha 3$) can be substantially equal to the second angle (e.g., $\theta 1$, $\theta 2$, $\theta 3$).

In the exemplary embodiments of FIGS. 4A, 5A, and 6A, the first angle (e.g., $\alpha 1$, $\alpha 2$, $\alpha 3$) can be different than the second angle (e.g., $\theta 1$, $\theta 2$, $\theta 3$). More particularly, the first angle (e.g., $\alpha 1$, $\alpha 2$, $\alpha 3$) preferably can be less than the second angle (e.g., $\theta 1$, $\theta 2$, $\theta 3$). In this manner, the exemplary embodiment can provide sufficient clearance for movement of the valve stem 14 along the channel and around the corners connecting the first and second channel portions. In another exemplary embodiment, the first and second sidewalls of the third channel portion similarly can be arranged at angles with respect to the first and second sidewalls of the second channel portion. As with the exemplary arrangement explained above, the angles between the second channel portion and the third channel portion can be different to provide clearance for movement of the valve stem 14 along the channel and around the corners connecting the second and third channel portions.

Additionally or alternatively, a length of a portion of the first sidewall can be different than a length of a corresponding opposed portion of the second sidewall, as illustrated for example in FIGS. 4A-6B. In this manner, the exemplary embodiment can provide sufficient clearance for movement of the valve stem 14 along the channel and around the corners connecting the first and second channel portions, or the second and third portions, etc.

Figure 7A:
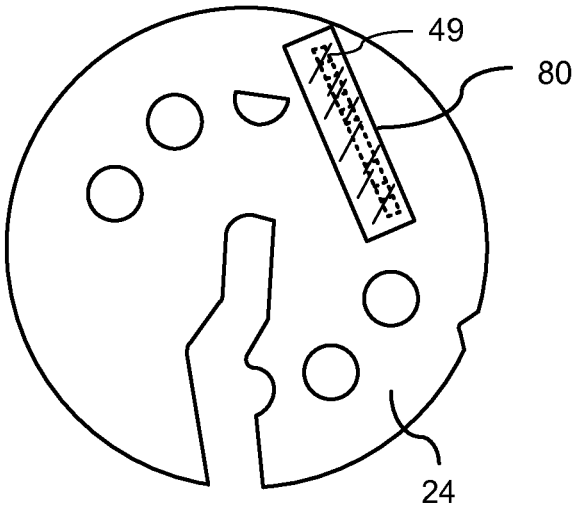
FIG. 7A is a rear view of a wiper rotor having an insulator according to another exemplary embodiment of the invention.
Figure 7B:
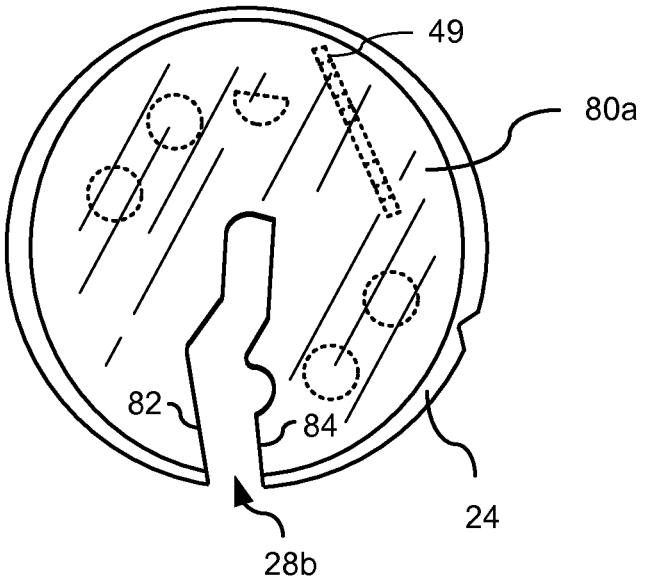
FIG. 7B is a rear view of a wiper rotor having an insulator according to another exemplary embodiment of the invention.

With reference to FIGS. 7A and 7B, the openings 49 formed in the wiper rotor 24 for securing the wipers 55 to the wiper rotor may expose a portion of the wipers 55 to the gas valve 12. An exemplary embodiment of a potentiometer 20 can include a wiper rotor 22 having an insulating film 80 corresponding to the opening 49 for receiving and securing the wipers 55 to the wiper rotor 24. In this manner, the exemplary embodiments can provide a potentiometer that can comply, for example, with standards and regulations from regulatory organizations such as Underwriters Laboratories, Inc. (UL), by providing an insulating material (e.g., insulating film 80, 80*a*) between the portion of the wipers 55 (which are disposed in the openings 49 formed in the wiper rotor 24 to secure the wipers 55 to the wiper rotor 24) and the gas valve 12.

The insulating film 80, 80*a* can be disposed on a rear side of the wiper rotor 24 (i.e., an opposite side of the wiper rotor 24 from the wipers 55). As illustrated in the exemplary embodiment of FIG. 7A, an insulating film 80 can cover only a portion of the wiper rotor 24 corresponding to the attachment point of the wipers 55 to the wiper rotor 24.

As illustrated in the exemplary embodiment of FIG. 7B, an insulating film 80*a* can cover substantially an entire planar surface of the wiper rotor 24. In this exemplary embodiment, the insulating film 80*a* can include a channel defined by interior edges or sidewalls 82 and 84 such that the channel corresponds substantially to the channel 28*b* of the wiper rotor, thereby minimizing or avoiding interference with the sliding of the potentiometer 20 onto the valve stem 14, for example, from the top, side, or bottom.

The insulating film 80, 80*a* can include, for example, an insulating material having an adhesive backing. In a preferred embodiment, the insulating film 80, 80*a* can include a polyester strip, such as a 0.010" polyester strip, having a self-sticking adhesive backing In other embodiments, the insulating material 80, 80*a* can be adhered to the surface of the wiper rotor 24 using an adhesive, tape, or the like.

In yet another exemplary embodiment, the insulating material 80, 80*a* can include a separate part, such as an insulating disc, that is coupled to the wiper rotor 24, the housing 26, or secured between the wiper rotor 24 and the housing 26, thereby providing an insulating barrier between the wipers 55 and the gas valve 12 irrespective of the radial position of the wipers 55.

With reference to again to FIGS. 3C, 3D, and 4B, an exemplary embodiment the circuit board 22 can include a connector 70 that is positioned on the circuit board 22 such that the connectors extend away from the circuit board 24 in a direction substantially parallel to the axis of rotation A1 of the wiper rotor 24 when the potentiometer 20 is in an assembled state.

With reference FIGS. 8A-8D, another exemplary embodiment of the circuit board 22 can include a connector 70 that is positioned on the circuit board 22 such that the connectors extend away from the circuit board 24 in a direction substantially perpendicular to the axis of rotation A1 of the wiper rotor 24 when the potentiometer 20 is in an assembled state.

With reference to FIGS. 8A-8D, exemplary embodiments of a method of removing a potentiometer 20 from a valve stem 14 of the a gas valve 12 after the potentiometer 20 has been installed in a cooking appliance, and replacing the potentiometer 20, will now be described.

Figure 8A:
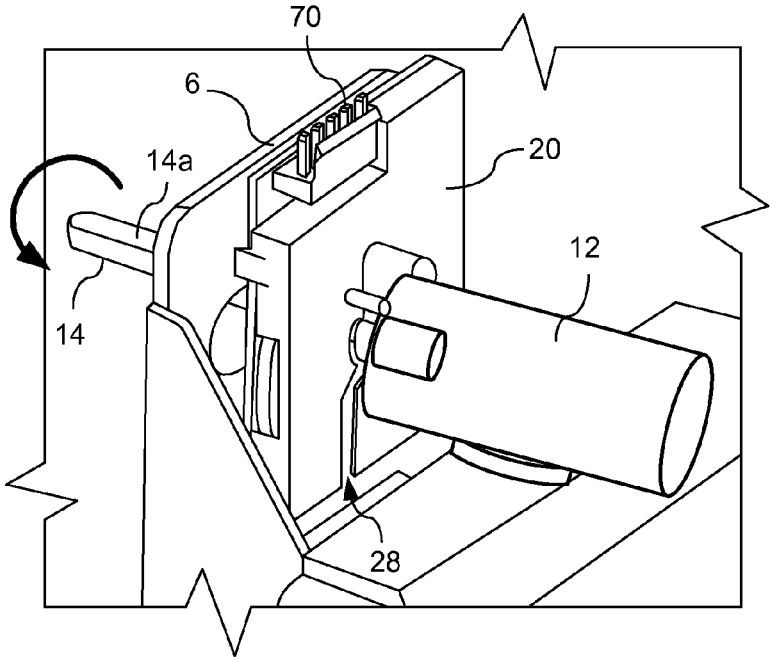
FIG. 8A is a rear, perspective view of a step of removing a potentiometer from a simmer controller assembly according to another exemplary embodiment of the invention.
Figure 8B:
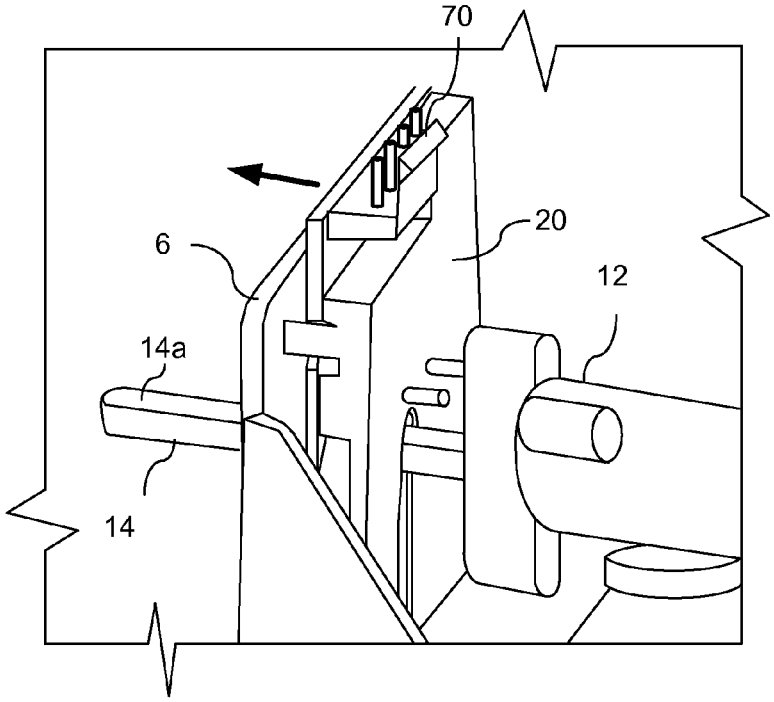
FIG. 8B is a rear, perspective view of a step of removing a potentiometer from a simmer controller assembly according to another exemplary embodiment of the invention.
Figure 8C:
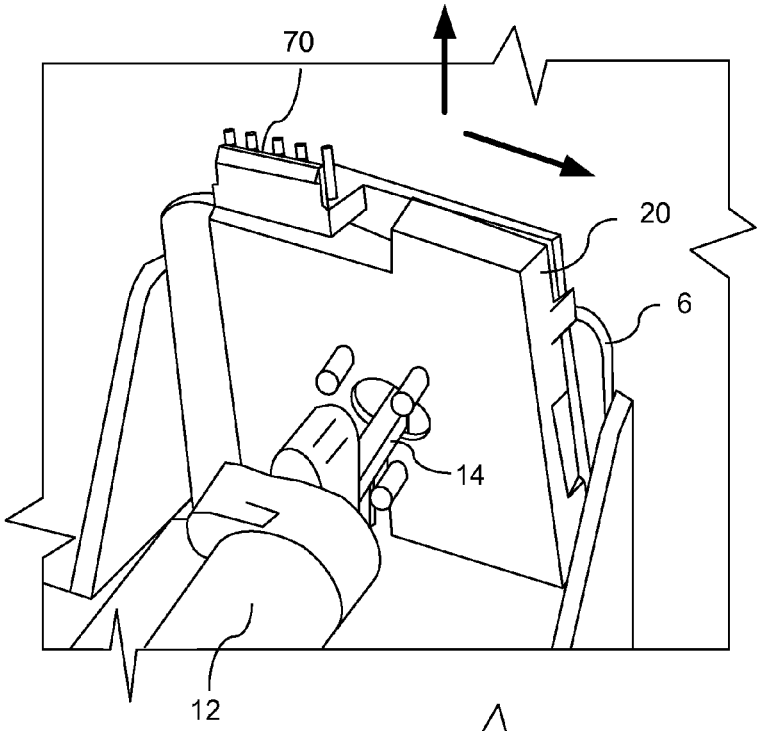
FIG. 8C is another rear, perspective view of a step of removing a potentiometer from a simmer controller assembly according to another exemplary embodiment of the invention.
Figure 8D:
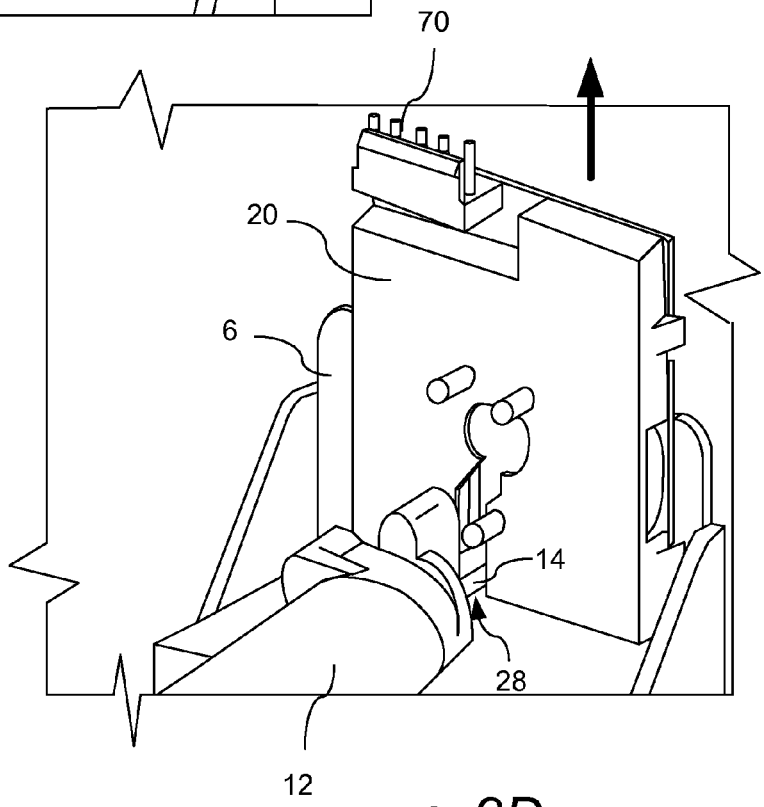
FIG. 8D is another rear, perspective view of a step of removing a potentiometer from a simmer controller assembly according to another exemplary embodiment of the invention.

As shown in FIG. 8A, when the potentiometer 20 is installed in the cooking appliance, the opening 40 of the wiper rotor 24 is engaged with the valve stem 14 of the gas valve 12. In a preferred exemplary embodiment, the flat cam surface 46 of the opening 40 is oriented toward the top of the potentiometer 20 to correspond to the position of the flat cam surface 14*a* of the valve stem 14. Additionally, the locking tabs 66 of the housing 26 can be engaged with a body of the gas valve 12 such that the circuit board 24 and the housing 26 of the potentiometer 20 do not rotate with respect to the gas valve 12.

In operation, the potentiometer 20 can be removed from the simmer control assembly by first rotating the valve stem 14 of the gas valve 12 until the channel 28*b* of the wiper rotor 24 is aligned with the channels 28*a* and 28*c* of the circuit board 24 and the housing 26. For example, in an exemplary embodiment, the valve stem 14 can be rotated in a counter-clockwise direction, for example by about 100°, thereby aligning the channel 28*b* of the wiper rotor 24 with the channels 28*a* and 28*c* of the circuit board 24 and the housing 26, respectively.

Once the channels 28*a*, 28*b*, and 28*c* are aligned, the locking tabs 66 of the housing 26 can be disengaged from the gas valve 12 by moving the potentiometer 20 in a forward direction (i.e., a direction away from the gas valve 12 and toward the control panel 6).

The potentiometer 20 then can be pulled or lifted in an upward direction, and if needed, in one or more lateral directions, such that the valve stem 14 is guided along the channel 28 (i.e., channels 28*a*, 28*b*, and 28*c*) as the potentiometer 20 moves relative to the valve stem 14.

For example, if the channel 28 is a straight channel, then the potentiometer 20 can be lifted upward in a single direction until the valve stem 14 exits and the potentiometer 20 disengages from the valve stem 14. If the channel 28 is a curved channel, as shown for example in FIG. 3E, then the potentiometer 20 can be moved along the curved path of the channel 28 until the valve stem 14 exits and the potentiometer 20 disengages from the valve stem 14. If the channel 28 includes a plurality of angles portions, such as first, second, and third portions (e.g., as exemplarily illustrated in FIG. 4B), then the potentiometer 20 can be moved in an upward direction and lateral directions based on the shape of the channel 28 until the valve stem 14 exits the channel 28 and the potentiometer 20 disengages from the valve stem 14.

After the channel 28 of the potentiometer 20 disengages from the valve stem 14, the potentiometer 20 can be removed from the simmer control assembly by lifting the potentiometer 20 out from the space between the control panel 6 and the gas valve 12.

A replacement potentiometer 20 then can be installed on the valve stem without disturbing the other components of the simmer control assembly. For example, the wiper rotor 24 of the potentiometer 20 can be rotated until the channel 28*b* of the wiper rotor 24 is aligned with the channels 28*a* and 28*c* of the circuit board 24 and the housing 26. For example, the wiper rotor 24 can be rotated in a counter-clockwise direction to align the channel 28*b* of the wiper rotor 24 with the channels 28*a* and 28*c* of the circuit board 24 and the housing 26, respectively.

Once the channels 28*a*, 28*b*, and 28*c* are aligned, the potentiometer 20 can be lowered downward onto the valve stem 14 and until the valve stem 14 engages the channel 28. The potentiometer 20 then can continue to be lowered, and if needed, moved in one or more lateral directions, such that the valve stem 14 is guided along the channel 28 (i.e., channels 28*a*, 28*b*, and 28*c*) as the potentiometer 20 moves relative to the valve stem 14.

Once the valve stem 14 is seated in the opening 40 of the wiper rotor 24, the potentiometer 20 can be moved in a rearward direction (i.e., a direction toward the gas valve 12 and away from the control panel 6) until the locking tabs 66 of the housing 26 can be engaged with the body of the gas valve 12, thereby securing the potentiometer 20 in a fixed position with respect to the gas valve 12.

In this manner, the exemplary embodiments provide a potentiometer 20 for a simmer assembly that can be quickly and efficiently removed and replaced, for example, without removing the control knob 8 from the valve stem 14 or removing the valve stem 14 from the control panel 6, thereby reducing an amount of time needed to perform service, reducing the cost of servicing the simmer assembly, and/or eliminating the performance of an additional leak test after replacing the potentiometer 20.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A potentiometer for a household cooking appliance, the household cooking appliance including a gas valve having a valve stem, the potentiometer comprising:

a circuit board having a contact;

a wiper rotor that is rotatable with respect to the circuit board and having an opening at an axis of rotation of the wiper rotor, the opening of the wiper rotor for engaging the valve stem of the gas valve, the wiper rotor including a wiper electrically contacting the contact of the circuit board;

a housing coupled to the circuit board and enclosing the wiper rotor between the housing and the circuit board; and a first interior edge and a second interior edge formed in each of the circuit board, the wiper rotor, and the housing and defining a channel extending from an outer edge of the potentiometer to the opening of the wiper rotor to permit the valve stem of the gas valve to pass through the channel from the outer edge of the potentiometer to the opening of the wiper rotor.

2. A potentiometer for a household cooking appliance, the household cooking appliance including a gas valve having a valve stem, the potentiometer comprising:

a circuit board having a contact;

a wiper rotor that is rotatable with respect to the circuit board and having an opening at an axis of rotation of the wiper rotor, the opening of the wiper rotor for engaging the valve stem of the gas valve, the wiper rotor including a wiper electrically contacting the contact of the circuit board; and a housing coupled to the circuit board and enclosing the wiper rotor between the housing and the circuit board, the housing having an opening with a center substantially corresponding to the axis of rotation of the wiper rotor, wherein the housing includes a first interior edge and a second interior edge defining a first channel extending from an outer edge of the housing to the opening of the housing to permit the valve stem of the gas valve to pass through the first channel from the outer edge of the housing to the opening of the housing and the opening of the wiper rotor.

3. The potentiometer of claim 2, wherein the circuit board has an opening with a center substantially corresponding to the axis of rotation of the wiper rotor, and wherein the circuit board includes a first interior edge and a second interior edge defining a second channel extending from an outer edge of the circuit board to the opening of the circuit board.

4. The potentiometer of claim 3, wherein the wiper rotor includes a first interior edge and a second interior edge defining a third channel extending from an outer edge of the wiper rotor to the opening of the wiper rotor.

5. The potentiometer of claim 4, wherein the first channel of the housing substantially corresponds to and is fixed with respect to the second channel of the circuit board.

6. The potentiometer of claim 5, wherein a size and a shape of the first channel of the housing substantially corresponds to a size and a shape of the second channel of the circuit board.

7. The potentiometer of claim 5, wherein the wiper rotor is movable between a first position in which the third channel of the wiper rotor substantially is aligned with one of the first channel of the housing and the second channel of the circuit board, and a second position in which the third channel of the wiper rotor substantially is not aligned with the one of the first channel of the housing and the second channel of the circuit board.

8. The potentiometer of claim 6, wherein a size and shape of the third channel of the wiper rotor substantially corresponds to the size and shape of the first channel of the housing and the second channel of the circuit board.

9. The potentiometer of claim 2, wherein the first channel is a straight channel.

10. The potentiometer of claim 2, wherein the first channel is a curved channel.

11. The potentiometer of claim 2, wherein the first channel includes one of a straight channel portion and a curved channel portion.

12. The potentiometer of claim 2, wherein the first channel includes a first channel portion and a second channel portion, and wherein the second channel portion is at an angle with respect to the first channel portion.

13. The potentiometer of claim 12, wherein each of the first channel portion and the second channel portion includes a first sidewall opposed to a second sidewall, wherein the first sidewall of the first channel portion adjoins and is at a first angle with respect to the first sidewall of the second channel portion, wherein the second sidewall of the first channel portion adjoins and is at a second angle with respect to the second sidewall of the second channel portion, and wherein the first angle is different than the second angle.

14. The potentiometer of claim 12, wherein a length of the first sidewall of the first channel portion is different than a length of the second sidewall of the first channel portion.

15. The potentiometer of claim 12, wherein the first channel includes a third channel portion that is at an angle with respect to the second channel portion.

16. The potentiometer of claim 2, wherein the wiper rotor includes a disc-shaped wiper rotor.

17. The potentiometer of claim 2, comprising:

an insulating film on the wiper rotor at a location corresponding to an attachment location of the wiper to the wiper rotor, the insulating film being disposed on an opposite side of the wiper rotor from the attachment location of the wiper to the wiper rotor.

18. The potentiometer of claim 2, wherein the circuit board includes a connector including a plurality of electrical connectors extending from the circuit board in a direction parallel to the axis of rotation of the wiper rotor.

19. A household cooking appliance having a simmer control assembly, the household cooking appliance comprising:

a control panel;

a gas valve having a body and a valve stem projecting from the body, the valve stem rotatably coupled to the body, the gas valve disposed on a first side of the control panel, the valve stem engaging an opening of the control panel such that a free end of the valve stem extends through the opening and projects from the control panel on a second side of the control panel;

a control knob coupled to the free end of the valve stem on the second side of the control panel; and a potentiometer that detects a rotating position of the valve stem, the potentiometer coupled to the valve stem on the first side of the control panel, wherein the potentiometer comprises:

a circuit board having a contact;

a wiper rotor that is rotatable with respect to the circuit board and having an opening at an axis of rotation of the wiper rotor, the opening of the wiper rotor for engaging the valve stem of the gas valve, the wiper rotor including a wiper electrically contacting the contact of the circuit board;

a housing coupled to the circuit board and enclosing the wiper rotor between the housing and the circuit board; and a first interior edge and a second interior edge formed in each of the circuit board, the wiper rotor, and the housing and defining a channel extending from an outer edge of the potentiometer to the opening of the wiper rotor to permit the valve stem of the gas valve to pass through the channel from the outer edge of the potentiometer to the opening of the wiper rotor.

20. A household cooking appliance having a simmer control assembly, the household cooking appliance comprising:

a control panel;

a gas valve having a body and a valve stem projecting from the body, the valve stem rotatably coupled to the body, the gas valve disposed on a first side of the control panel, the valve stem engaging an opening of the control panel such that a free end of the valve stem extends through the opening and projects from the control panel on a second side of the control panel;

a control knob coupled to the free end of the valve stem on the second side of the control panel; and a potentiometer that detects a rotating position of the valve stem, the potentiometer coupled to the valve stem on the first side of the control panel, wherein the potentiometer comprises:

a circuit board having a contact;

a wiper rotor that is rotatable with respect to the circuit board and having an opening at an axis rotation of the wiper rotor, the opening of the wiper rotor for engaging the valve stem of the gas valve, the wiper rotor including a wiper electrically contacting the contact of the circuit board; and a housing coupled to the circuit board and enclosing the wiper rotor between the housing and the circuit board, the housing having an opening with a center substantially corresponding to the axis of rotation of the wiper rotor, wherein the housing includes a first interior edge and a second interior edge defining a first channel extending from an outer edge of the housing to the opening of the housing to permit the valve stem of the gas valve to pass through the first channel from the outer edge of the housing to the opening of the housing and the opening of the wiper rotor.

21. The household cooking appliance of claim 20, wherein the circuit board has an opening with a center substantially corresponding to the axis of rotation of the wiper rotor, and wherein the circuit board includes a first interior edge and a second interior edge defining a second channel extending from an outer edge of the circuit board to the opening of the circuit board.

22. The household cooking appliance of claim 21, wherein the wiper rotor includes a first interior edge and a second interior edge defining a third channel extending from an outer edge of the wiper rotor to the opening of the wiper rotor.

23. The household cooking appliance of claim 21, wherein the first channel of the housing substantially corresponds to and is fixed with respect to the second channel of the circuit board.

24. The household cooking appliance of claim 23, wherein the wiper rotor is movable between a first position in which the third channel of the wiper rotor substantially is aligned with one of the first channel of the housing and the second channel of the circuit board, and a second position in which the third channel of the wiper rotor substantially is not aligned with the one of the first channel of the housing and the second channel of the circuit board.

25. The household cooking appliance of claim 23, wherein a size and a shape of the first channel of the housing substantially corresponds to a size and a shape of the second channel of the circuit board.

26. The household cooking appliance of claim 25, wherein a size and shape of the third channel of the wiper rotor substantially corresponds to the size and shape of the first channel of the housing and the second channel of the circuit board.

27. The household cooking appliance of claim 20, comprising:

an insulating film on the wiper rotor at a location corresponding to an attachment location of the wiper to the wiper rotor, the insulating film being disposed on an opposite side of the wiper rotor from the attachment location of the wiper to the wiper rotor and interposing the attachment location of the wiper to the wiper rotor and the body of the gas valve.

28. The household cooking appliance of claim 20, wherein the circuit board includes a connector including a plurality of electrical connectors extending from the circuit board in a direction parallel to the axis of rotation of the wiper rotor and away from the control panel.

29. The household cooking appliance of claim 20, wherein a width of the first channel is one of equal to and greater than a width of the valve stem of the gas valve.

30. The potentiometer of claim 1, wherein the circuit board includes electrical components, and wherein the first interior edge and the second interior edge formed in the circuit board defines a curved channel extending from the outer edge of the potentiometer to the opening of the wiper rotor, the curved channel being curved around the electrical components of the circuit board.

31. The potentiometer of claim 1, wherein the circuit board includes electrical components, wherein the channel defined by the first interior edge and the second interior edge formed in the circuit board includes a first channel portion and a second channel portion extending between the electrical components of the circuit board, and wherein the second channel portion is at an angle with respect to the first channel portion.

32. The potentiometer of claim 1, wherein an axis extending through a center of the opening of the wiper rotor is coaxial with the axis of rotation of the wiper rotor.

33. The potentiometer of claim 17, wherein the insulating film is disposed on the opposite side of the wiper rotor only at a portion of the wiper rotor corresponding to the attachment location of the wiper to the wiper rotor.

34. The potentiometer of claim 17, wherein the insulating film is disposed on the opposite side of the wiper rotor and covers substantially an entire planar surface of the opposite side of the wiper rotor.

35. The potentiometer of claim 4, further comprising:

an insulating film on the wiper rotor at a location corresponding to an attachment location of the wiper to the wiper rotor, the insulating film being disposed on an opposite side of the wiper rotor from the attachment location of the wiper to the wiper rotor, wherein the insulating film is disposed on the opposite side of the wiper rotor and covers substantially an entire planar surface of the opposite side of the wiper rotor, and wherein the insulating film includes a channel corresponding to the third channel of thw wiper rotor and extending from the outer edge of the wiper rotor to the opening of the wiper rotor.

* * * * *